United States Patent [19]

Talbott et al.

[11] Patent Number: 4,745,731

[45] Date of Patent: May 24, 1988

[54] APPARATUS AND METHOD FOR FORMING RECLOSABLE STORAGE CONTAINERS

[75] Inventors: Ronnie D. Talbott, Battle Creek, Mich.; Thomas Tedeschi, Jr., Monmouth Junction, N.J.; Michael P. Hughes, Marshall, Mich.

[73] Assignee: General Foods Corporation, White Plains, N.Y.

[21] Appl. No.: 17,512

[22] Filed: Feb. 24, 1987

[51] Int. Cl.[4] ..... B65B 61/00

[52] U.S. Cl. ..... 53/451; 53/551

[58] Field of Search ..... 53/469, 451, 551, 552, 53/562

[56] References Cited

U.S. PATENT DOCUMENTS

| | | | |
|---|---|---|---|
| 3,681,890 | 8/1972 | Pringle et al. | 53/552 |
| 3,815,317 | 6/1984 | Toss | 53/28 |
| 3,831,821 | 8/1974 | Doyen | 53/451 |
| 3,879,917 | 4/1975 | Bassendale et al. | 53/552 |
| 4,235,064 | 11/1980 | Wenger | 53/451 |
| 4,355,494 | 10/1982 | Tilman | 53/451 |
| 4,576,588 | 3/1986 | Umeda et al. | 53/551 |

FOREIGN PATENT DOCUMENTS

| | | | |
|---|---|---|---|
| 102740 | 5/1962 | Netherlands | 53/552 |

*Primary Examiner*—Robert L. Spruill
*Assistant Examiner*—Donald R. Studebaker
*Attorney, Agent, or Firm*—Sam D. Walker; Thomas R. Savoie; Daniel J. Donovan

[57] ABSTRACT

An apparatus and a method for forming reclosable storage containers are provided to form and seal pouches containing products such as consumer food products. The film material handled thereby and the pouches thus formed include an access opening assembly having a reclosable closure assembly that is characterized by mating flexible closure strips having interlocking means that permit the consumer to easily open and readily and positively reclose the formed pouch. The apparatus and method engage together mating strips of film material sheeting to form a substantially closed web of sheet material that is generally spread or flattened and otherwise handled in order to minimize the formation of kinks and the like in seals formed by the apparatus and method.

25 Claims, 3 Drawing Sheets

APPARATUS AND METHOD FOR FORMING RECLOSABLE STORAGE CONTAINERS

BACKGROUND AND DESCRIPTION OF THE INVENTION

The present invention generally relates to an apparatus and method for forming reclosable storage containers such as flexible pouches having an easily openable and readily reclosable access opening that has mating flexible closure strips with complementary interlocking profiles. In its typical form, the invention includes features for filling and sealing as well as for forming the storage containers. The invention is especially suitable for providing reclosable storage containers in connection with packaging food products within a container assembly including a flexible pouch that is within a carton formed from a foldable sheet material, this type of container assembly being generally known as a bag-in-box packaging assembly.

Packaging of products for retail sale and consumption has developed gradually over the years in order to enhance the ease with which the consumer can open the packaging in order to gain access thereto for use or consumption of the food product therewithin. It is necessary for such packaging, before it is first opened by the consumer, to serve as a long-term storage container while the package is in warehouse storage and is on the retail shelf. Another desirable attribute of such packaging is that it provide an assembly that closes securely and in as air-tight a manner as possible in order to maintain the freshness of the food product remaining within the package. Food products that are typically thus packaged and stored within a box or carton having an internal liner or pouch include dry cereal products, especially such cereal products that require hermetic sealing from atmospheric air and humidity conditions during warehouse and retail shelf storage.

Heretofore, sealing of these types of products in these types of packages has been adequately achieved for warehouse and retail shelf storage prior to initial opening by the consumer. However, substantial difficulties have been encountered in incorporating an access opening into this type of packaging such that it will reclose or rescal in a secure and substantially air-tight manner so as to avoid premature deterioration of the food product within the packaging after its original seal that was formed at the packaging plant has been broken by the consumer. Various approaches have been taken in this regard. With most food products, including breakfast cereal products, such approaches often center upon providing a pouch opening that permits the consumer to fold over the top end of the pouch and reclose the top end or a portion of the top end of the carton or box by a suitable assembly including various tabs, slits, folds, tear paths and the like. Such a reclosing approach is usually adequate to prevent unintentional spillage or dust contamination of the product, but same is less than satisfactory for maintaining the freshness of the product and preventing its deterioration due to the excessive passage of air through the reclosed access openings.

Another disadvantage of a typical previously utilized closure arrangement for a bag or pouch of the type that is suitable for use within a box or carton assembly is the difficulty in opening the access assembly of the bag or pouch. Often, such assemblies require a tearing of the top sealing portion of the bag or pouch which, once torn, is permanently damaged and cannot easily be manipulated for adequate closure. Other sealing arrangements are intended to involve the pulling apart or delamination of opposing panels of pouch material which is intended to avoid such tearing. Usually, this approach is not entirely satisfactory because the seal to be pulled apart must be adequate to permit warehouse or retail shelf storage for many months, which requires adherence characteristics that are typically too tenacious to permit easy opening or breaking of that adherence seal when the package is to be opened by the consumer. This situation typically results in tearing of the film material sheets by the consumer which leads to the resultant inability to adequately reclose the pouch and container.

The present invention recognizes that an important step in overcoming these shortcomings and deficiencies is attained by forming, filling and sealing pouches having a reclosable closure assembly that includes mating flexible closure strips. When such mating flexible closure strips are handled, difficulties arise because of the bulkiness associated with mating flexible closure strips. A particular problem that arises in this regard is the development of excessive undesirable creases or fold-overs during formation of the pouch. To a great extent, the present invention substantially limits or avoids these deformities by controlling movement of the mated flexible closure strips while the pouch forming material supporting the strips is being oriented for completion of its formation into filled and sealed pouches suitable for bag-in-box container assemblies.

Achieving such control according to the apparatus and method of this invention includes using a web spreading assembly having a structure for quiding previously mated longitudinal strips that are located generally along a longitudinal edge of a flowing web of flexible sheet material. The flowing web is initially wrapped generally around a fill tube structure and the strips are mated to form a generally circular joined web. The spreading assembly manipulates the joined web as it flows in order to gradually transform same from a generally circular cross-section to a spread or flattened, generally elliptical cross-section. Such spreading can be facilitated by providing a fill tube assembly that has a tapering outside surface which permits the desired change of cross-sectional shape to begin to occur at a location that is more upstream than would otherwise be possible.

The apparatus and method according to the present invention which embody these features has the ability to form, fill and seal pouches that provide warehouse and shelf storage attributes which are adequate for many food products while forming pouches that possess an access opening seal which is readily openable without tearing the pouch material. Furthermore, once such access opening is initially opened by the consumer, it is readily reclosable in a secure and air passage inhibiting manner.

It is accordingly a general object of the present invention ot provide an imporved apparatus and method for forming reclosable storage containers.

Another object of this invention is to provide an improved apparatus and method for forming reclosable storage pouches from a web of flexible sheet material having matable and flexible closure strips while controlling or avoiding the formation of wrinkles or folds along sealing areas of the pouches thus formed.

Another object of the present invention is to provide an improved apparatus and method for forming reclosable storage containers having an access arrangement which, while being easy to open, is a tightly sealed assembly that permits detection of tampering or pilfering activities before purchase or use by the consumer.

Another object of this invention is to provide an improved form-fill-seal apparatus and method that manipulate and form film material sheets into pouches, fill those pouches with food material product, and seal the pouches in a hermetic manner and is a condition suitable for insertion within boxes or cartons that are closely sized to the bag or pouch.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
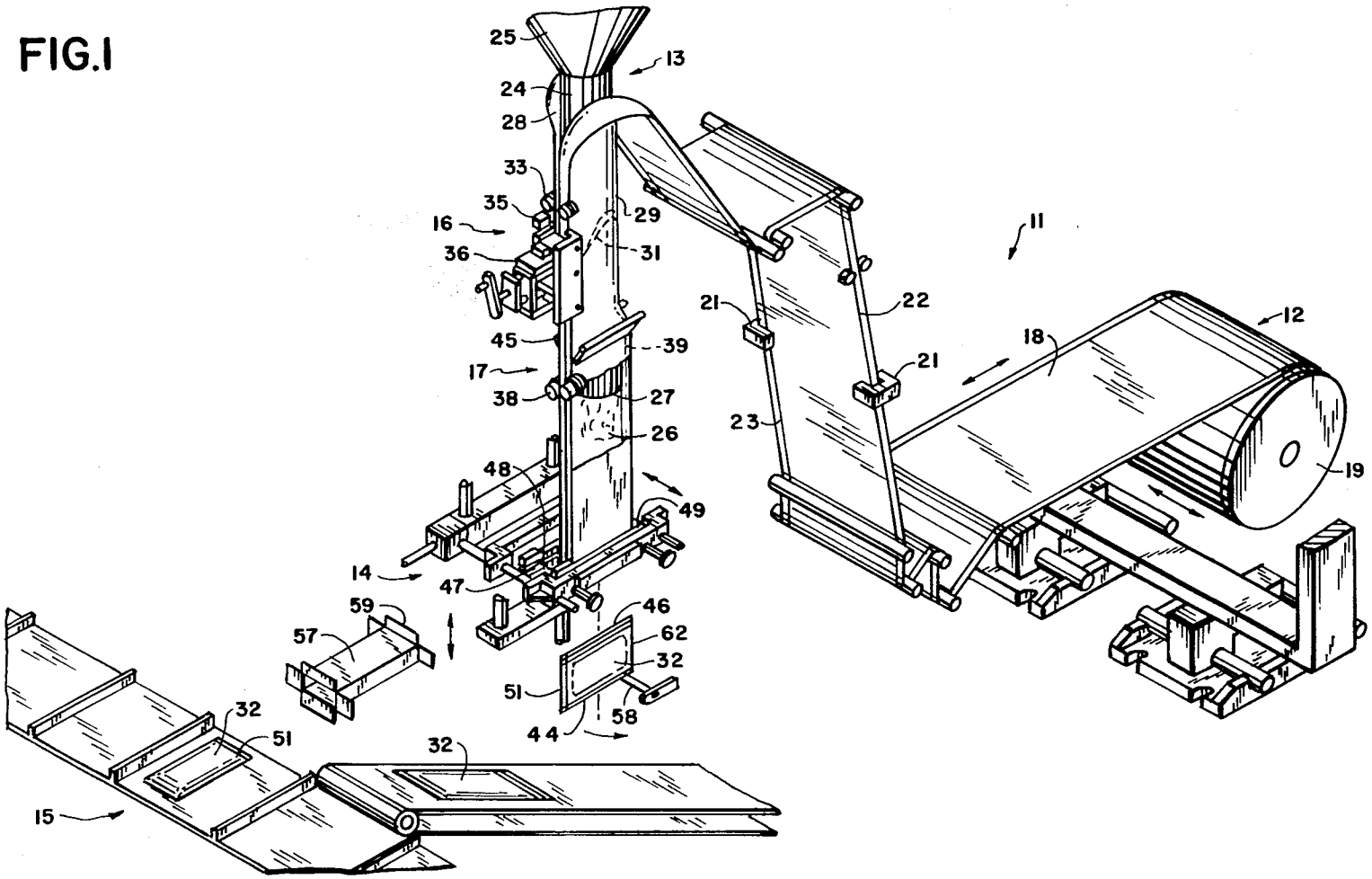
FIG. 1 is a perspective view of the preferred aparatus according to the invention for forming, filling, sealing and boxing reclosable storage containers.

The form-fill-seal apparatus, generally designated as 11 in FIG. 1, includes an unwind stand, generally designated as 12, a fill assembly, generally designated as 13, a horizontal sealing and serving assembly, generally designated as 14, and a bag-into-box insertion assembly, generally designated as 15. An engagement assembly, generally shown as 16, is positioned substantially along the fill assembly 13, and a web spreading assembly, generally designated as 17, is positioned therebelow.

Unwind stand 12 is preferably of the type that achieves automatic guidance of film material sheeting 18 as it unwinds from a roll 19 that moves laterally in response to signals generated at sensors 21. The device controls the positioning of the unwound web so that the edges thereof are precisely positioned with respect to the filling assembly 13. In this manner, mating flexible closure strips 22 and 23, to the extent that they are precisely positioned with respect to the respective edges of the sheeting 18, are also precisely aligned when they engage the fill assembly 13. The illustrated, preferred unwind stand 12 is of the electromechanical type such as those available from Fife Corporation which are suitable for automatic web control guiding of thin plastic film material to within a few thousandths of an inch. Other available devices, which are typically less suitable, are of the electrohydraulic or pneumohydraulic type having photoelectric sensors and the like. Especially advantageous sensors 21 include light emitting diodes that emit infrared light which travels across the sensor gap and to a solar cell.

Figure 5:
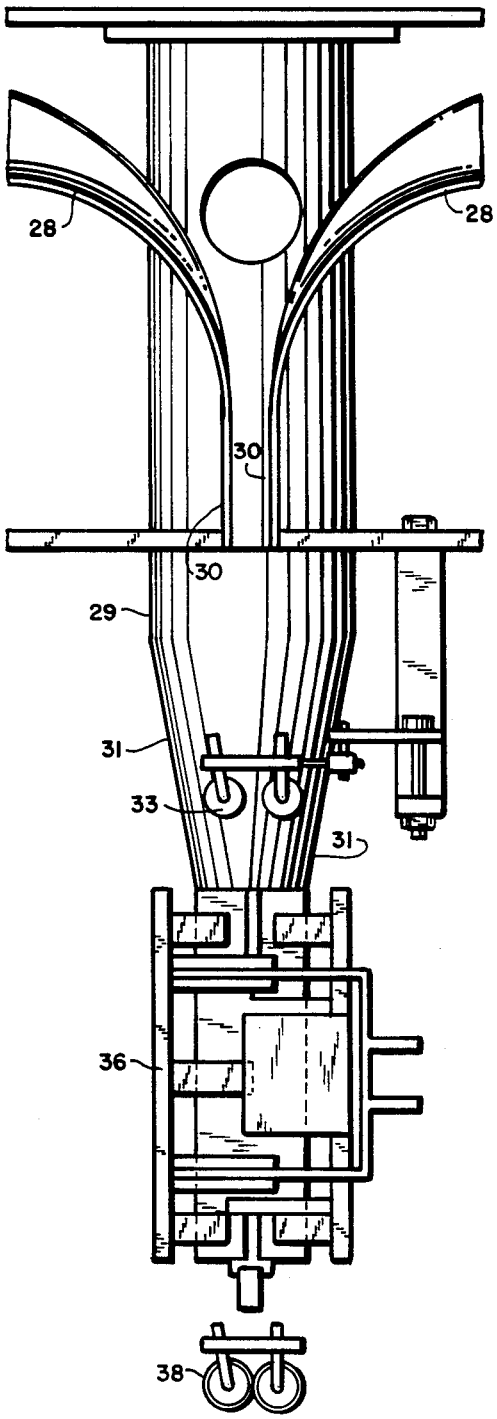
FIG. 5 is an elevational view of the preferred form, fill and seal assembly illustrated in FIG. 1.

Fill assembly 13 includes a generally internal cylinder 24 having a hopper arrangement 25 or other suitable structure for supplying product to be filled into and through the cylinder 24, such product 26 exiting the cylinder 24 through opening 27. A forming collar 28 is positioned above a shaping cylinder 29 having opposing angled cut-outs 31. FIG. 5 more particularly illustrates the preferred forming collar 28 that assists in suitably aligning the film material sheeting 18 while and after it is wrapped therearound so as to bring the flexible closure strips 22 and 23 to a location for engaging same together. Forming collar 28 includes downwardly directed extensions 30 which oppose one another in order to provide a gradually tapering slot that provides added guidance for the free edges of the film material sheeting 18 and for the flexible closure strips 22 and 23 while still providing adequate flexibility of sheeting movement that aids in achieving the mating of the flexible closure strips 22 and 23 that is accomplished according to the present invention.

Figure 2:
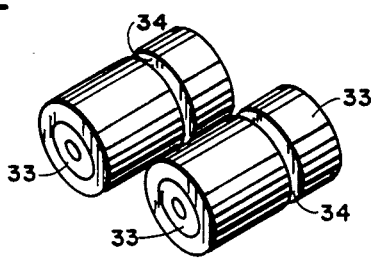
FIG. 2 is an enlarged perspective view of components fo the preferred flexible closure strip engagement assembly illustrated in FIG. 1.

Engagement assembly 16 accomplishes joining of the free edges of the film material sheeting in a manner so as to form access opening assemblies for pouches 32 that are ultimately formed. Such, preferably includes at least one pair of pinch rollers 33, shown in greater detail in FIG. 2. The opposing edges of the film material sheeting, by the time the flow thereof reaches the engagement assembly 16, are aligned in juxtaposition such that the mating flexible closure strips 22 and 23 into and through the engagement assembly 16, some freedom of movement of the strips 22 and 23 is allowed by the assembly so as to permit the strips 22 and 23 to slide into complete alignment with each other until their respective interlocking profiles fully and securely engage and interlock. The achievement of this feature is due in part to positioning the pinch rollers 33 a substantial distance from the forming collar 28 so that the film material sheeting 18 can accommodate movement of the mating flexible closure strips 22 and 23 that might be needed in order to complete aligned interengagement thereof.

Pinch rollers 33 typically may include an annular groove 34 which functions to both accommodate and guide the mating flexible closure strips 22 and 23, which typically have a thickness that is significantly greater than that of the body of the film material sheeting 18. Pinch rollers 33 are preferably mounted at an angle not to exceed 45° from the horizontal by an appropriate bracket assembly or the like (FIG. 5). They are preferably of a relatively light weight in order to minimize tearing of the film material sheeting 18 while still being rigid enough to accomplish their engagement or pinching function. Bearing-mounted hollow aluminum cylinders are suitable, for example.

In order to check that the pinch rollers 33 have adequately interengaged the mating flexible closure strips 22 and 23, a detector device 35 is preferably positioned between the pinch rollers 33 and the guiding assembly 38. For best results, however, the detector device 35 is preferably positioned generally immediately upstream of the guiding assembly 38. A suitable detector device 35 is an air detector of known construction which, through pressure differential readings, can signal the operator or the control mechanism of the apparatus that unsatisfactory interengagement has occurred in order that appropriate corrective measures can be taken.

Figure 6:
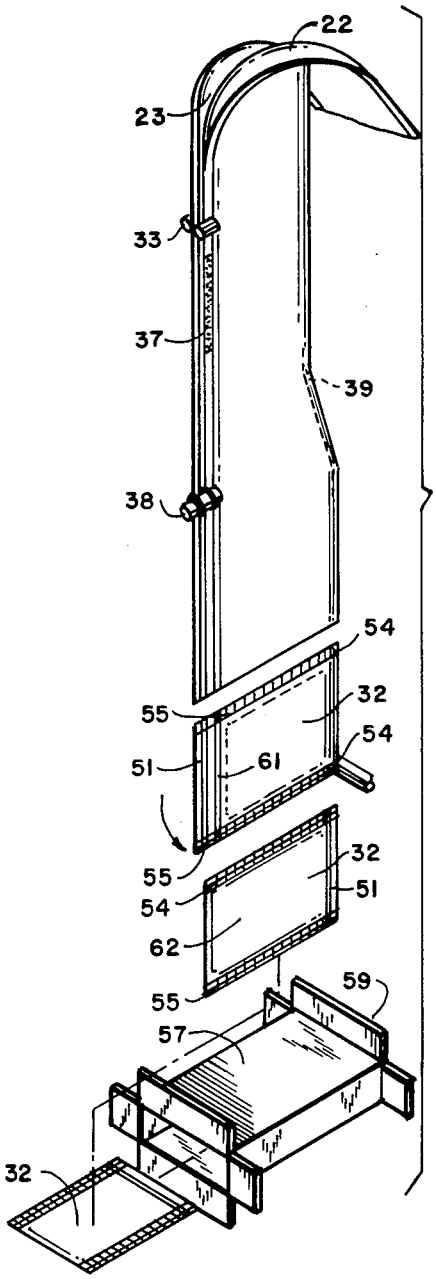
FIG. 6 is a perspective, somewhat schematic view emphasizing web manipulation accomplished by the pouch forming, filling, sealing and boxing features according to the present invention.

Another component of the illustrated engagement assembly 16 is a seal forming assembly 36. The illustrated seal forming assembly imparts a heat seal to what will be the access opening of the pouch 32, which heat seal can be positioned on either side of the previously interengaged mating flexible closure strips 22 and 23. The illustrated seal forming assembly 36 includes a pair of heat sealing jaws that engage opposite faces of the wrapped film of material sheeting 18. In a typical embodiment thereof, one of such jaws is stationary, while the other pivots into engagement in order to effect the formation of the desired heat seal 37 (FIG. 6).

The web spreading assembly 17 includes a guiding assembly, generally shown at 38, for holding or maintaining proper alignment of the flowing, mated flexible closure strips 22 and 23 while the mated sheeting or joined web flows through the spreading assembly 17. Such spreading is accomplished by cooperation among the guiding assembly 38, an internally positioned finger 39 for engaging an opposite wall of the joined web, and the opposing angled cut-outs 31 in the shaping cylinder 29. Finger 39 exerts an outward force on the joined web to keep it stretched for the desired spreading thereof. Such finger 39 exhibits some bendability so as to accommodate product flow through the joined web. These features cooperate to spread or to modify the cross-sectional shape of the flowing mated sheeting or joined web from one that is substantially circular to one that is substantially a flattened circle which has a generally elliptical or pillow-like shape.

By this arrangement, the opposing faces of the leading edge of the flowing joined web are in engagement or are closely spaced from each other when they reach the horizontal sealing and severing assembly 14 for sealing same together immediately before the deposit of the product 26 into the forming pouch. This approach effectively controls the problem associated with attempts to form seals in sheeting having mating flexible closure strips and the like which are significantly more bulky than the rest of the sheeting and that are not easily controlled when included on a flowing web, such as that handled according to the present invention. For example, when the features of the web spreading assembly 17 are omitted from the apparatus, undesirable folds are formed when the seals are made by the horizontal sealing and severing assembly 14. These folds are formed when sheeting material at the leading edges folds onto itself, typically at a location that is generally adjacent to or closely spaced from the mated flexible closure strips 22 and 23.

Figure 3:
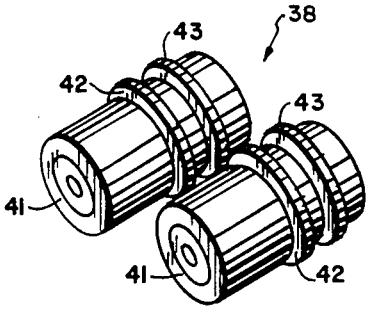
FIG. 3 is an enlarged perspective view of a portion of the guiding assembly for the web spreading means illustrated in FIG. 1.

Guiding assembly 38 is shown in greater detail in FIG. 3. In the preferred, illustrated structure, the guiding assembly 38 includes a pair of guide rollers 41 that are rotatably mounted by a suitable bracket assembly (not shown). Each guide roller 41 includes a pair of spaced O-rings 42 and 43. These O-rings 42 and 43 are seated in a groove to maintain their respective desired positions, effectively grasp the joined edge of the mated sheeting web and provide a surface that is pliable enough to avoid scoring damage to the web. A pliable material such as a rubber having a high coefficient of friction is typically suitable. The guide rollers 41 should afford sufficient tension means to prevent undesired separation thereof while the joined edge and the mated strips flow therethrough. Each pair of O-rings is aligned with the opposing pair of O-rings, with the mated strips flowing between the four O-rings.

The horizontal sealing and severing assembly 14 exhibits overall operating features that are generally known. Assembly 14 forms a leading seal 44 immediately prior to passage of the product 26 into the pouch being formed, the flow thereof typically being assisted by jogger bars 45. At substantially the same time that the leading seal 44 is formed, a following seal 46 is likewise formed by the assembly 14, at which time the film material is severed between the leading seal 44 of a pouch that is being formed and the trailing seal 46 of a pouch 32 that has just been formed.

Preferaby, low-grade compression members, such as the illustrated springs 47, are positioned immediately below the sealing and severing jaws 48 and 49. Such compression members 47 exert a moderate outward force against both faces of the pouch immediately before the following seal 46 is formed in order to thereby remove excess air from the pouch immediately before its formation is completed. The low-grade compression members can take the form of sponge material or the like that is positioned and that functions much in the same manner as do the illustrated springs.

Figure 4:
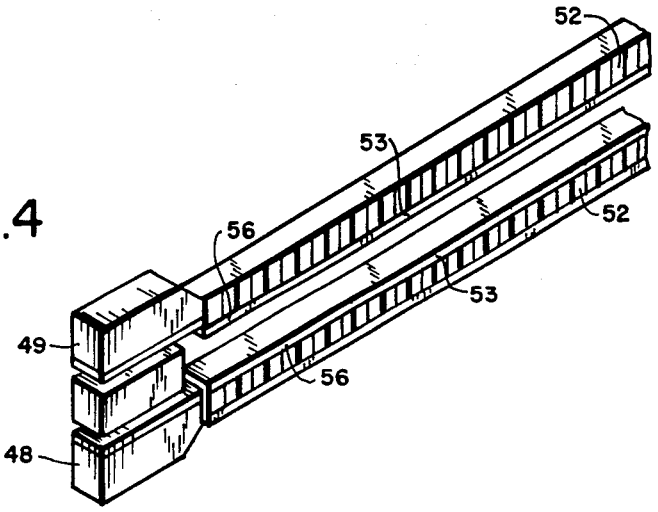
FIG. 4 is an enlarged perspective view of preferred die jaws incorporated into a sealing assembly of the invention.

Sealing and severing jaws 49 and 48 preferably include features that provide leading seals 44 and following seals 46, respectively, that are especially effective in forming pouches 32 having an access opening 51 that includes the mated flexible closure strips 22 and 23. With particular reference to FIG. 4, the working face of each jaw 48, 49 has two distinct die or seal bar patterns. Each has a serration die face 52, and each has a longitudinal narrow bar seal face 53. The serration die faces 52 form transverse serration seals 54 (FIG. 6) of the pouch 32, while the logitudinal narrow bar seal faces 53 form logitudinal bar seals 55, each of which is positioned outside of a transverse serration seal 54 in the complete pouch 32. Longitudinal bar seals 55 help to prevent the possibility of air passage through the transverse serration seals 54 in order to enhance the air-tight attributes of the leading seal 44 and of the following seal 46.

The longitudinal bar seals 55 are particularly useful for assisting in avoiding air leakage through the access opening assembly 51 due to the generally non-planar interface at the edges of the access opening assembly 51 due to the presence of the thicker engaged flexible closure strips 22 and 23. The longitudinal bar seals 55 substantially flatten these non-planar interface edges of the mated flexible closure strips 22 and 23 by heat-sealing procedures in order to thereby render same generally planar while effectively welding together the end edge portions of the mated flexible closure strips 22 and 23.

The longitudinal bars 48 and 49 of the present invention can be substantially straight throughout their respective lengths, or said bars can include contoured and mitered edges as an optional features in order to assist in the procedure of inserting the flexible pouch 32 within the container 57. The sealing pattern must follow mitering or contouring.

This latter feature of the longitudinal bar seals 55 is enhanced by modifying the longitudinal narrow bar seal faces 53 so that each includes two distinct portions that can be raised to different temperatures. More particularly, such modified longitudinal narrow bar seal faces 53 include a section 56 that provides a heat-sealing temperature which is greater than the remainder of the longitudinal narrow bar seal face 53. This section 56 is located at the end of the seal face 53 that engages the portion of the pouch 32 being formed which includes the access opening assembly 51. With this structure, greater sealing energy is imparted to the portion of the pouch 32 that includes the bulky mated flexible closure strips 22 and 23 in order to thereby more effectively seal same, while avoiding excessive sealing of the remainder of the leading seal 44 and following seal 46. By this arrangement, the ends of the access opening 51, and particularly of the mated flexible closure strips 22 and 23, are welded together to provide added protection against leakage thereacross and to provide additional strength along the side seals about the interlocking means.

After formation of the pouches 32 is completed, the pouches may be conveyed or otherwise handled for movement to the bag-into-box insertion assembly 15, which is of a generally known construction. Each pouch 32 is thereby inserted into a carton 57 which is subsequently closed and sealed in accordance with known procedures and using generally known devices. In the embodiment illustrated in FIG. 1, a kicker bar 58 is positioned below the sealing and severing assembly 14 and to one side thereof. Kicker bar 58 effects a 180-degree rotation of each pouch 32 in order to change the orientation thereof, if necessary, so as to position the access opening assembly 51 correctly with respect to the access end 59 of the carton 57.

The access opening assembly 51 formed according to the apparatus and method of this invention includes an openable or peelable adherence seal 61 (FIG. 6) that was formed at 37 by the seal forming assembly 36. This seal 61 is fashioned so at to be readily peelable by the consumer without causing tearing of the access opening assembly 51. When it is desired to provide an access opening assembly 51 that permits the consumer to detect whether or not such assembly has been tampered with, this seal 61 will not be reclosable. In this manner, once the seal 61 is broken or opened, it will not reseal onto itself, thereby providing a means for detecting when the access opening assembly has previously been opened. Another component of the access opening assembly 51 is, of course, the mated assembly of the flexible closure strips 22 and 23, which is substantially parallel to the openable or peelable seal 61. This mated assembly is readily opened by pulling the closure strips 22 and 23 apart, and they are readily joined together by engaging them and applying pressure thereto in a generally known manner.

The pouches 32 which are typically formed according to the apparatus and method of this invention are in the nature of so-called pillow bags or pouches which do not have a gussetted bottom or side. The closed folded edge 62 of the illustrated pouch 32 is formed when the film material sheeting 18 is folded onto itself. This closed folded edge 62 is substantially opposite to the access opening assembly 51.

It will be understood that the embodiments of the present invention which have been described are illustrative of some of the applications of the principles of the present invention. Numerous modifications may be made by those skilled in the art without departing from the true spirit and scope of the invention.

We claim:

1. A form, fill and seal apparatus of the type that forms film material into flexible pouches, the form, fill and seal apparatus including means for storing and supplying the film material, a generally vertical fill tube assembly downstream thereof and around which the sheet material is generally wrapped, and sealing and severing means downstream of the fill tube assembly for sealing and severing the sheet material into flexible pouches that enclose the filled product therewithin, wherein the apparatus comprises:

means associated with said film material storing and supplying means for providing a continuous web of film material having mating flexible closure strips longitudinally positioned at generally opposing locations along said continuous web of film material, said mating flexible closure strips having generally complementary interlocking means for selectively engaging and disengaging said strips from each other;

flexible closure strip engagement means associated with said generally vertical fill tube assembly, said engagement means engaging said mating flexible strips together to form a flow of continuous joined web of film material having mated flexible closures strips;

web spreading means located generally vertically downstream of said engagement means, said web spreading means receiving said continuous joined web of film material to modify its cross-section, configuration by increasing a longitudinal dimension of its cross-section, said web spreading means including means for guiding said mated flexible closure strips during passage of the joined web through said spreading means;

a pair of pinch rollers positioned a substantial distance down stream from a forming collar so that the film material can accomodate movement of the mating flexible closure strips into alignment with each other until their respective interlocking profiles interlock; and said sealing and severing means seals and severs said joined web downstream of said spreading means for completing formation of pouches from said joined web.

2. The apparatus according to claim 1, wherein said flexible closure strip engagement means includes a pair of pinch rollers through which the web of film material flows, and said pinch rollers contact the web of film material at respective location in general alignment with the flexible closure strips.

3. The apparatus according to claim 2 wherein each pinch roller is mounted at an angle not to exceed 45° from the horizontal for accommodating the flexible closure strip during flow of the film material between said pinch rollers.

4. The apparatus according to claim 2, wherein each pinch roller has annular groove means for accommodating the flexible closure strips during flow of the film material between said pinch rollers.

5. The apparatus according to claim 1, further including seal forming means positioned downstream of said closure strip engagement means for sealing said film material to itself in a pattern that is closely spaced from and generally parallel to said mated flexible closure strips.

6. The apparatus according to claim 5, wherein said seal forming means includes a heat sealing assembly.

7. The apparatus according to claim 1, wherein said guiding means of the web spreading means includes a pair of guide rollers through which said mated flexible closure strips of the joined web flow.

8. The apparatus according to claim 7, wherein said pair of guide rollers each include ring means for engaging the web of film material and for generally restricting transverse movement of said mated flexible closure strips while same flow between said guide rollers.

9. The apparatus according to claim 1, wherein said web spreading means further includes generally flexible finger means positioned within said joined web flow at a location generally opposing said guiding means, said finger means being for cooperating with said guiding means to spread said joined web flow which engages both said guiding means and said finger means.

10. The apparatus according to claim 1, wherein said web spreading means further includes cut-out means in said fill tube assembly for cooperating with said guiding means to taper the cross-sectional configuration of said joined web from a generally circular cross-section at location upstream of said cut-out means to a generally elliptical cross-section at said guiding means.

11. The apparatus according to claim 1, wherein said web spreading means further includes a generally flexible finger means positioned within said joined web flow at a location generally opposing said guiding means, said web spreading means also including cut-out means in said full tube assembly, and said finger means and said cut-out means are for cooperating with said guiding means to spread said joined web flow.

12. The apparatus according to claim 11, wherein said guiding means of the web spreading means includes a pair of guide rollers through which said mated flexible closure strips of the joined web flow.

13. The apparatus according to claim 1, wherein said film material storing and supplying means includes means for positioning said flexible closure strips along predetermined respective longitudinal paths.

14. The apparatus according to claim 1, wherein said fill tube assembly includes an upstream-positioned forming collar having downwardly directed extension means for providing gradually tapering extended guidance for said flexible closure strips.

15. The apparatus according to claim 1, wherein said sealing and severing means includes jaws having a serration die face means for forming transverse serration seals on leading and following edges of the joined web, said jaws further having longitudinal narrow bar seal face means for forming longitudinal seals outside of both of said transverse serration seals.

16. The apparatus according to claim 15 wherin said jaws have a contoured configuration.

17. The apparatus according to claim 15, wherein said longitudinal narrow bar seal face means includes means for sealing non-planar interface edges of said mated flexible closure strips.

18. The apparatus according to claim 17, wherein said means for sealing non-planar interface edges includes a section of said longitudinal narrow bar seal face means that provides a heat-sealing temperature greater than that of other portions of said longitudinal narrow bar seal face means.

19. A form, fill and seal method for forming film material into flexible pouches, filling the pouches with product and sealing the pouches, wherein the method comprises:

providing a continuous web of film material having mating flexible closure strips longitudinally positioned at generally opposing locations along said continuous web of film material, said mating flexible closure strips having generally complementary interlocking means for selectively engaging and disengaging said strips from each other;

guiding the mating flexible strips together by means of a pair of pinch rollers positioned a substantial distance down stream from a forming collar so that the film material can accomodate movement of the mating flexible closure strips into alignment with each other until their respective interlocking profiles interlock.

engaging said mating flexible strips together to form a flow of continuous joined web of film material having mated flexible closure strips;

thereafter spreading said flow of continuous joined web of film material to modify its cross-sectional configuration by increasing a longitudinal dimension of its cross-section, said web spreading step including guiding said mated flexible closure strips; and sealing and severing said joined web at a location downstream of the location of said spreading step in order to complete formation of pouches from said joined web.

20. The method according to claim 19, wherein said flexible closure strip engaging step includes passing the web of film material through pinch rollers.

21. The method according to claim 19, further including forming a seal after said closure strip engaging step in order to seal said film material to itself in a pattern that is closely spaced from and generally parallel to said mated flexible closure strips.

22. The method according to claim 19, wherein said guiding step of the joined web spreading step includes passing flexible closure strips of the joined web through guide rollers.

23. The method according to claim 19, wherein said joined web spreading step further includes passing said joined web along a generally flexible finger at a location generally opposing that of said guiding step.

24. The method according to claim 19, wherein said sealing and severing step includes forming transverse serration seals on leading and following edges of the joined web and forming longitudinal bar seals outside of both of said transverse serration seals.

25. The method according to claim 22, wherein said step of forming longitudinal bar seals forms heat seals and includes imparting a heat at a greater temperature to non-planar interface edges of the mated flexible closure strips, said greater temperature being in excess of the temperature of that imparted to other portions of the joined web.

* * * * *

UNITED STATES PATENT AND TRADEMARK OFFICE

Certificate

Patent No.: 4,745,731 Patented: May 24, 1988

On petition requesting issuance of a certificate for correction of inventorship pursuant to 35 U.S.C. 256 it has been found that the above-identified patent, through error and without any deceptive intent, improperly sets forth the inventorship. Accordingly, it is hereby certified that the correct inventorship of this patent is:
Ronnie D. Talbott, Thomas Tedeschi, Jr., Michael P. Hughes and Orlo E. Gard, Jr.

Signed and Sealed this Twentieth Day of February, 1990

ROBERT L.SPRUILL

*Supervisory Patent Examiner*
*Art Unit 321*